US011238879B2

(12) United States Patent
Raghunandan et al.

(10) Patent No.: US 11,238,879 B2
(45) Date of Patent: Feb. 1, 2022

(54) ACOUSTIC DELAY MEASUREMENT USING ADAPTIVE FILTER WITH PROGRAMMABLE DELAY BUFFER

(71) Applicant: Microsemi Semiconductor (U.S.) Inc., Austin, TX (US)

(72) Inventors: Siddharth Raghunandan, Austin, TX (US); David Colby, Austin, TX (US); Dean Morgan, Kanata (CA)

(73) Assignee: Microsemi Semiconductor (U.S.) Inc., Austin, TX (US)

( * ) Notice: Subject to any disclaimer, the term of this patent is extended or adjusted under 35 U.S.C. 154(b) by 106 days.

(21) Appl. No.: 16/176,377

(22) Filed: Oct. 31, 2018

(65) Prior Publication Data

US 2019/0130929 A1 May 2, 2019

Related U.S. Application Data

(60) Provisional application No. 62/580,603, filed on Nov. 2, 2017.

(51) Int. Cl.

| | |
|---|---|
| ***G10L 21/0232*** | (2013.01) |
| ***H04R 3/04*** | (2006.01) |
| ***H04R 29/00*** | (2006.01) |
| ***G10L 21/0208*** | (2013.01) |

(52) U.S. Cl.

CPC ..... *G10L 21/0232* (2013.01); *G10L 21/0208* (2013.01); *H04R 3/04* (2013.01); *H04R 29/001* (2013.01); *G10L 2021/02082* (2013.01)

(58) Field of Classification Search

CPC ..... G10L 21/0232; G10L 21/0208; G10L 2021/02082; H04R 3/04; H04R 29/001

See application file for complete search history.

(56) References Cited

U.S. PATENT DOCUMENTS

| | | | | |
|---|---|---|---|---|
| 5,117,401 A | | 5/1992 | Feintuch | |
| 5,761,638 A | * | 6/1998 | Knittle | H04B 3/23 379/406.03 |
| 5,793,864 A | * | 8/1998 | Ramsden | H04M 3/323 379/24 |
| 9,712,866 B2 | | 7/2017 | Lasser | |
| 9,997,151 B1 | * | 6/2018 | Ayrapetian | G10K 11/178 |

(Continued)

*Primary Examiner* — Fan S Tsang
*Assistant Examiner* — Daniel R Sellers
(74) *Attorney, Agent, or Firm* — Glass & Associates; Kenneth Glass

(57) ABSTRACT

An acoustic delay measurement apparatus measures an audio delay introduced by an audio system. A programmable delay buffer, which introduces a programmable delay into the audio stream, receives an audio stream from an audio source and outputs a reference signal representing the audio stream. An adaptive filter is responsive to the reference signal to generate an estimate signal to match on convergence of the adaptive filter an audio signal output by the audio system, which is the audio stream delayed by an amount representative of the audio delay introduced by the audio system. A processor including a coefficient analysis block reads coefficients in the adaptive filter after convergence, computes a delay introduced into said estimate signal by the adaptive filter, and adds the computed delay to the programmable delay buffer to provide a measurement of the audio delay.

15 Claims, 5 Drawing Sheets

(56) References Cited

U.S. PATENT DOCUMENTS

| | | | | |
|---|---|---|---|---|
| 2002/0131583 | A1* | 9/2002 | Lu | H04B 3/23 379/406.08 |
| 2003/0235294 | A1* | 12/2003 | Dyba | H04B 3/23 379/406.01 |
| 2006/0062398 | A1* | 3/2006 | McKee Cooper | H04S 7/301 381/58 |
| 2015/0078564 | A1* | 3/2015 | Guo | G10L 21/0208 381/66 |
| 2015/0371654 | A1* | 12/2015 | Johnston | G10L 21/0232 381/66 |

* cited by examiner

ACOUSTIC DELAY MEASUREMENT USING ADAPTIVE FILTER WITH PROGRAMMABLE DELAY BUFFER

FIELD OF THE INVENTION

This invention relates to the field of acoustics, and in particular to a method and apparatus for determining the inherent acoustic delay or audio latency in an audio system, and to an echo cancellation circuit.

BACKGROUND OF THE INVENTION

It is often desirable to measure the time delay of a signal through an audio system. For example, it may be necessary to measure the difference in time delay as an audio signal passes through each of a plurality of speakers compared to a reference audio signal when trying to ensure synchronization between the speakers. Traditionally, time delay measurement techniques in an audio system involve using a known impulse signal. One method involves performing a cross-correlation between a transmitted impulse signal and the recorded audio signal. This method involves a training period while the adaptive algorithm adapts to the audio characteristics of the room, and requires calibration tones or known reference tones. Other methods include use of time-domain reflectometry where a pulse or a short sine wave burst is transmitted from the audio system. Measurements are then made of the timing of the return echo. The afore mentioned methods are susceptible to ambient noise and multi-modal reverberation and/or echo in a room. As a result, the recorded audio signal or return echo signal is never an exact replica of the original transmitted signal.

Also, adaptive filters are used for echo cancellation. In certain applications, such as in the case of TV set top boxes, the echo is delayed by an amount that exceeds the capacity of the adaptive filter. Increasing the filter size is not practical for digital signal processing reasons.

SUMMARY OF THE INVENTION

Embodiments of the invention address these problems by employing a converged adaptive filter coupled to a programmable delay buffer to determine the inherent delay of an audio system.

According to as aspect of the present invention there is provided an acoustic delay measurement apparatus for measuring an audio delay introduced by an audio system, comprising a programmable delay buffer operative to receive an audio stream from an audio source and output a reference signal representing the audio stream, said programmable delay buffer being operative to introduce a programmable delay into the audio stream; an adaptive filter responsive to said reference signal to generate an estimate signal to match on convergence of the adaptive filter an audio signal output by the audio system, said audio signal comprising said audio stream delayed by an amount representative of the audio delay introduced by the audio system; and a processor including a coefficient analysis block operative to read coefficients in the adaptive filter after convergence, compute a delay introduced into said estimate signal by the adaptive filter, and add the computed delay to the programmable delay buffer by to provide a measurement of said audio delay.

Initially the programmable delay may be set to zero. Alternatively, it could be set to a reasonable estimate of the anticipated delay in the audio system. If the adaptive filter converges, which is determined by comparing the error signal output by the filter with the audio signal, the delay introduced by the adaptive filter is computed.

If the adaptive filter fails to converge on reaching its maximum delay, a preset delay is programmed into the programmable delay buffer and the process repeated. This process can be done iteratively until the adaptive filter converges.

The adaptive filter may be a Least Mean Squares filter, but other types of filter may be employed. The filter delays the reference signal output by the programmable delay buffer and generates an estimate signal, which attempts to match the input audio signal. The difference between the two represents the error signal.

Once convergence has been found, the delay introduced by the adaptive filter into the estimated signal may be computed by finding the coefficient where a predetermined threshold value is exceeded.

If this coefficient represents the last coefficient in the adaptive filter, the programmable delay can again be set to a certain value, say 75% of the size of the adaptive filter, and the adaptive filter again allowed to converge. In this case, it is likely that the threshold will be exceeded before the coefficient index reaches the last coefficient in the filter. The effect of the programmable delay buffer is thus effectively to extend the size of the adaptive filter.

The delay measured by the apparatus in accordance with the invention can be used for various purposes. For example, it can be used to align the audio from being played out from different sources.

Also, it can be used to extend the effective size of an adaptive filter used for echo cancellation by incorporating a delay buffer in the reference path. The delay buffer is programmed with the delay measured by the measuring apparatus.

According to another aspect of the present invention, there is provided a computer-implemented method of determining audio latency in an audio system, comprising applying an audio stream obtained from an audio source to the audio system possessing latency; applying a first audio signal obtained from the audio system to a first input of an adaptive filter; applying a reference signal to a second input of said adaptive filter to permit said adaptive filter to generate an estimate signal of said first audio signal upon convergence, said reference signal being obtained from said audio stream after passing through a programmable delay buffer; if said adaptive filter fails to converge, incrementing said programmable delay buffer by a determined amount and restarting said adaptive filter; and upon convergence of said adaptive filter computing the delay introduced by said adaptive filter into said estimate signal and adding the computed delay to the programmable delay buffer to provide a measurement of the audio delay.

According to yet another aspect of the invention there is provided an echo cancellation circuit, comprising a first input for receiving an input signal potentially containing an echo signal; an output for outputting an output signal with said echo at least partially attenuated; a second input for receiving an audio signal subject to delay that produces said echo signal; an adaptive filter responsive to a reference signal and said output signal to generate an estimate of said echo signal; a programmed delay buffer introducing a pre-measured delay into said audio signal to provide said reference signal for said adaptive filter; and a subtractor for subtracting said estimate signal from said input signal to provide said output signal.

DETAILED DESCRIPTION

Figure 1:
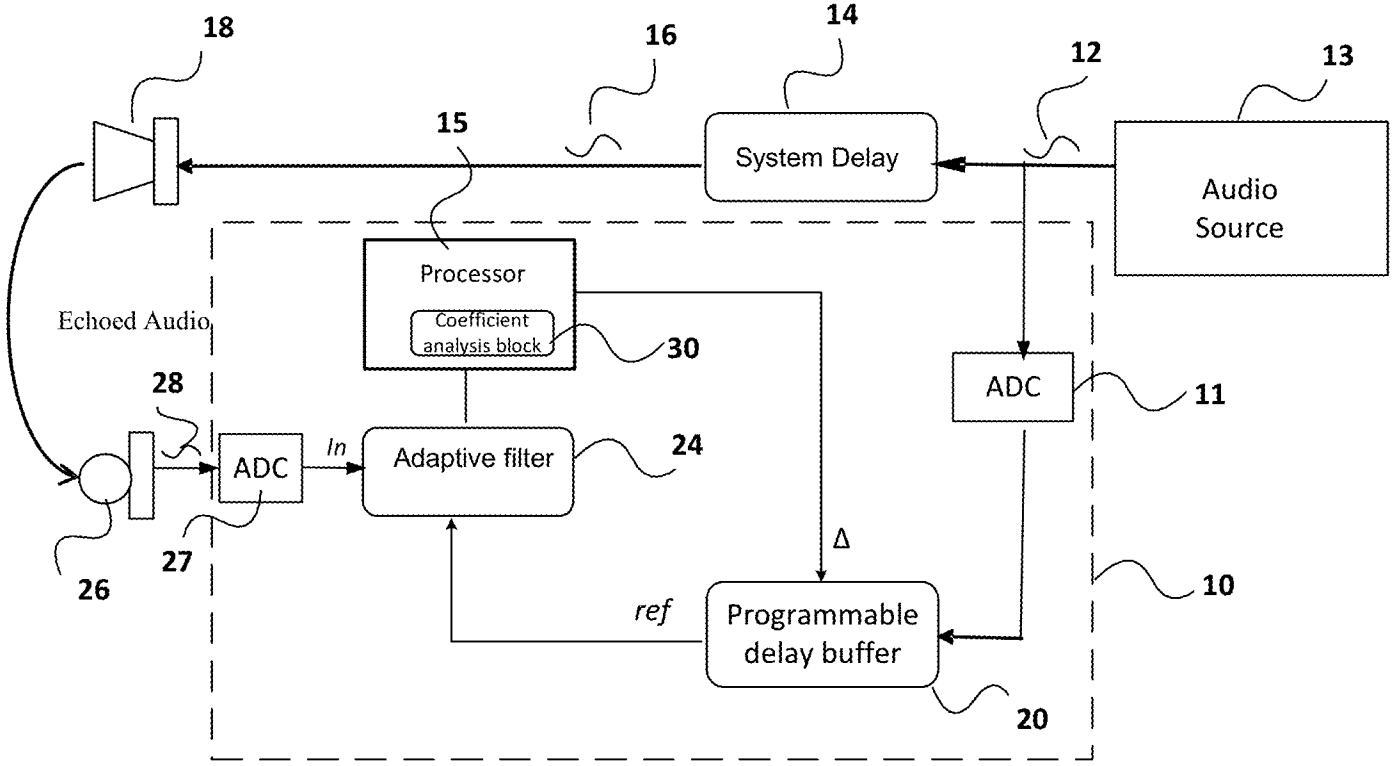
FIG. 1 shows an audio system including an acoustic delay measurement apparatus in accordance with one embodiment of the invention.

FIG. 1 shows an acoustic delay measurement apparatus 10 for determining the audio latency in an audio system 14 coupled to speaker 18. The acoustic delay measurement apparatus 10 comprises a programmable delay buffer 20, an adaptive filter 24, and a coefficient analysis block 30. In the present embodiment, a least mean squares (LMS) algorithm is used for the adaptive filter 24, but other types of adaptive filter algorithms may also be used. The apparatus runs generally under the control of processor 15, which includes the coefficient analysis block 30.

An audio stream 12 is output from an audio source 13. The audio stream 12 does not need to be a pre-known signal or tone, and can be, for example, any wideband signal. The audio stream 12 is input into the audio system 14 and to the acoustic delay measurement apparatus 10.

The audio system 14 has an inherent time delay or latency, which is commonly due to contributors such as analog-to-digital conversion, buffering, digital signal processing and digital-to-analog conversion. Due to the inherent latency of the audio system 14, a delay is created in the audio stream 12 resulting in a delayed audio stream 16, which is input to the speaker 18.

The purpose of the apparatus 10 is to measure this inherent delay. In order to make a measurement of this delay, the audio stream 12 is digitized in analog-to-digital converter 11 and input to the programmable delay buffer 20, which generates a programmable delay that may adjusted during the measurement process depending on the magnitude of the delay.

The delay introduced by the programmable delay buffer 20 is incremented when delay introduced by the audio system is greater than the maximum delay that can be offset by the adaptive filter. In this case part of the delay is offset in the programmable delay buffer 20, so the delay between the input signal In and the reference signal ref will be less than the total delay in the system by an amount equal to the delay programmed into the programmable delay buffer 20.

In order to make a measurement, the audio stream 12 is digitized in analog-to-digital converter 11 and input to the programmable delay buffer 20. The initial value of the adjustable delay is normally set to zero seconds, but is increased to a non-zero value if the delay is greater than the maximum delay available in the adaptive filter 24. Alternatively, the initial delay could be set to an approximation of the anticipated delay in the audio system.

The programmable delay buffer 20 outputs a reference signal ref representing the audio stream 12, which may be delayed by the amount programmed into the delay buffer 20, although as noted the reference signal may initially be output with zero delay. The reference signal ref is applied to one input of the adaptive filter 24.

Microphone 26 picks up the output of speaker 18, which corresponds to the delayed audio stream 16, and outputs a signal 28, which after passing through ADC 27 is applied as input signal In to the other input of the adaptive filter 24.

The adaptive filter 24 adjusts its filter coefficients automatically to generate an estimate signal est (FIG. 2) based on the reference signal ref that matches the input signal In by minimizing the error err between the filter input signal In, which includes the delay introduced by the audio system 14, and the estimated signal est. Initially, all the coefficients of the adaptive filter 24 are set to zero. Adaptive filtering is then performed for several samples of the values of the delayed audio stream 16 and the reference signal ref and given sufficient time to converge on a solution. This process is iterative and part of the normal function of the LMS filter, which adapts all the filter coefficients once per sample. For example, if there are 1024 coefficients then during one sample period 1024 coefficients are updated. It typically take 1-2 s for the system to converge, so the iterative process may occur 32000 times (all 1024 coefficients are updated 32000 times) before moving on to the next stage.

After the prescribed convergence time, which as noted is typically 1-2 seconds, adaptive filtering is stopped. Provided the average error signal err has fallen to an acceptable value, the current coefficients are analyzed in the coefficient analysis block 30 to compute the delay determined by the adaptive filter 24 that should be applied to the reference signal to match the input signal. If the error signal err is above a predetermined threshold, the delay is incremented in the programmable delay buffer 20 and the adaptive filtering restarted based on the delayed reference signal.

The resultant coefficient values of the adaptive filter 24 follow a predictive pattern. The speaker 18 and mic 26 are acoustically coupled. The coefficients represent the profile of the acoustic coupling. The values of the first few coefficients during the delay period will be close to zero. Acoustically coupled coefficients will have larger values. One of the coefficients will show an abrupt increase in value as the first audio is received from the speaker 18.

The coefficient analysis block 30 determines the number of coefficients between the first coefficient and the coefficient having the abrupt change in value. Using this number, as explained below, coefficient analysis block 30 determines a delay value A by dividing the number of coefficients between the first coefficient and the coefficient having the abrupt change in value, by the sampling rate of the adaptive filter 24. In the present embodiment, the sampling rate of the adaptive filter 24 is assumed to be the same as the sampling rate of the programmable delay buffer 20. In instances where the sampling rate differs, translation is required. The delay value A is added to the delay in the programmable delay buffer 20, which gives the current delay for the audio system.

Figure 2:
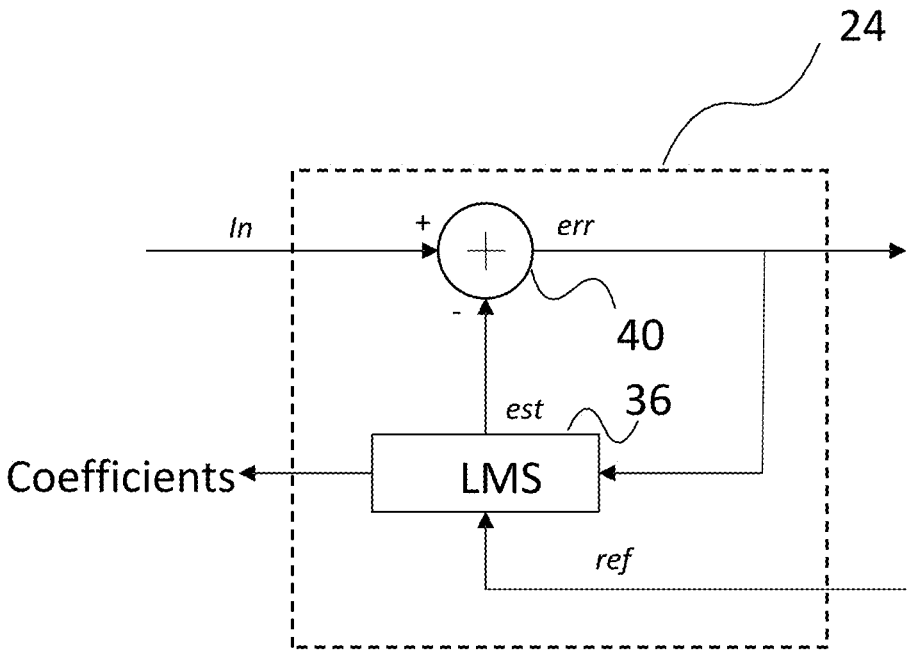
FIG. 2 shows a block diagram of an adaptive filter forming part of the apparatus.

FIG. 2 shows a block diagram of an embodiment of the adaptive filter 24 in more detail. Reference signal ref is input to adaptive filter block 36 which uses a Least Mean Square (LMS) algorithm to generate the estimated signal est.

The signal In is compared with the estimated signal est in adder 40 to generate error signal err, which represents the error between the input signal In and the estimated signal est. It will be understood in this context that the term "adder" covers a subtractor since a minus value is added to a positive value to determine the error.

As noted, if the ratio of error signal err is above a threshold, for example, 10 dB of the input signal In, the delay in programmable delay buffer 20 is incremented to reduce the delay between the signals ref and In, and the process restarted. The programmable delay buffer 20 thus has the effect of increasing the apparent size of the adaptive filter 24.

Figure 3:
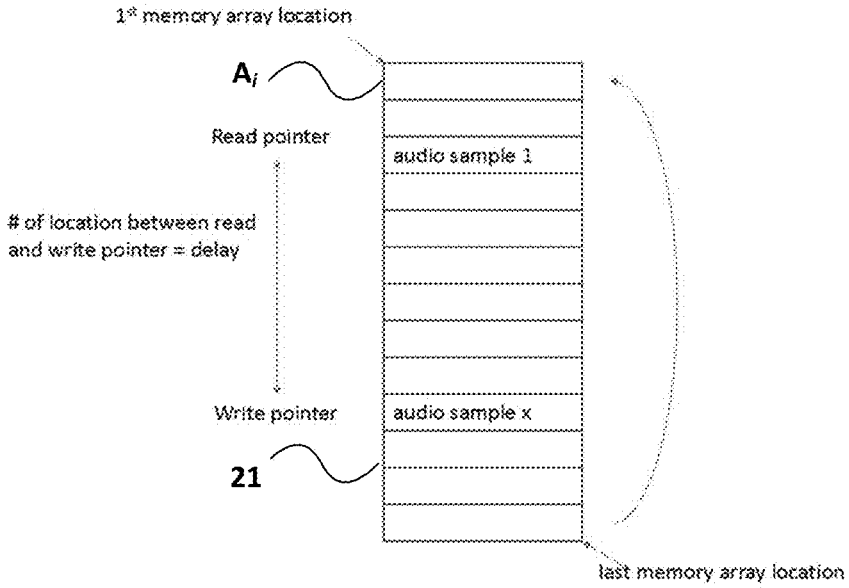
FIG. 3 shows an embodiment of the programmable delay buffer.

FIG. 3 shows one embodiment of the programmable delay buffer 20. This comprises a linear buffer having a series of memory locations $A_i$, where i=1 . . . n. A write pointer determines the address to which an input audio sample is written, and a read pointer determines the address from which an output audio sample is read. The write and read pointers move in synchronism, advancing by one location on each sample and wrapping round to the first address when they reach the end of the buffer. The number of memory locations between the write and read pointers determines the delay in the buffer. For example, if the current input sample is written at location 10 and the read pointer lags by 5 memory locations, the introduced delay will be equal to 5 samples.

Figure 4:
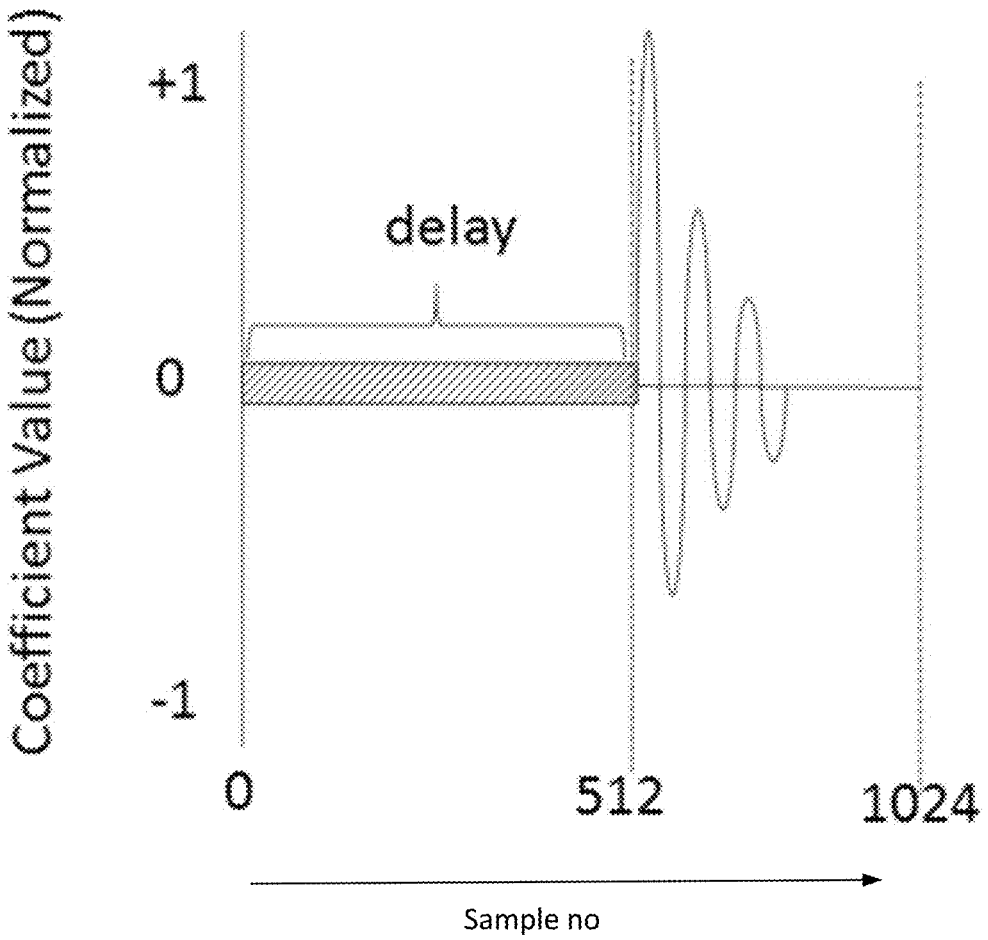
FIG. 4 illustrates the change in adaptive filter coefficients during the adaptive filtering process in a model system.

FIG. 4, which is based on an idealized model, illustrates how the values of the adaptive filter coefficients change during the adaptive filter process. As is shown in FIG. 4, the initial coefficient values are near zero. For example, the first 512 coefficients are near zero. The next few coefficients then show an abrupt increase in value as the estimate signal est matches the input signal In and the adaptive filter 24 converges.

Of interest is the number of coefficients between the first coefficient and the first coefficient showing the abrupt change in coefficient value that exceeds the threshold value. In FIG. 4, the number of coefficients between the first coefficient and the first coefficient showing the abrupt change in coefficient value is 512 coefficients. The coefficient analysis block 30 determines a delay value by dividing the number of coefficients between the first coefficient and the first coefficient showing the abrupt change in coefficient value, by the sampling rate of the adaptive filter. The reciprocal of the sampling rate gives the time between samples, and therefore the coefficient index times the reciprocal of the sampling rate gives the total delay to the first sample above the threshold. So, for example, referring to FIG. 4, if the sampling rate of the adaptive filter is 16 kHz (equivalent to 16000 coefficients/sec), then the delay is determined to be 512 coefficients divided by 16000 coefficients/sec which equates to 32 milliseconds.

Figure 5:
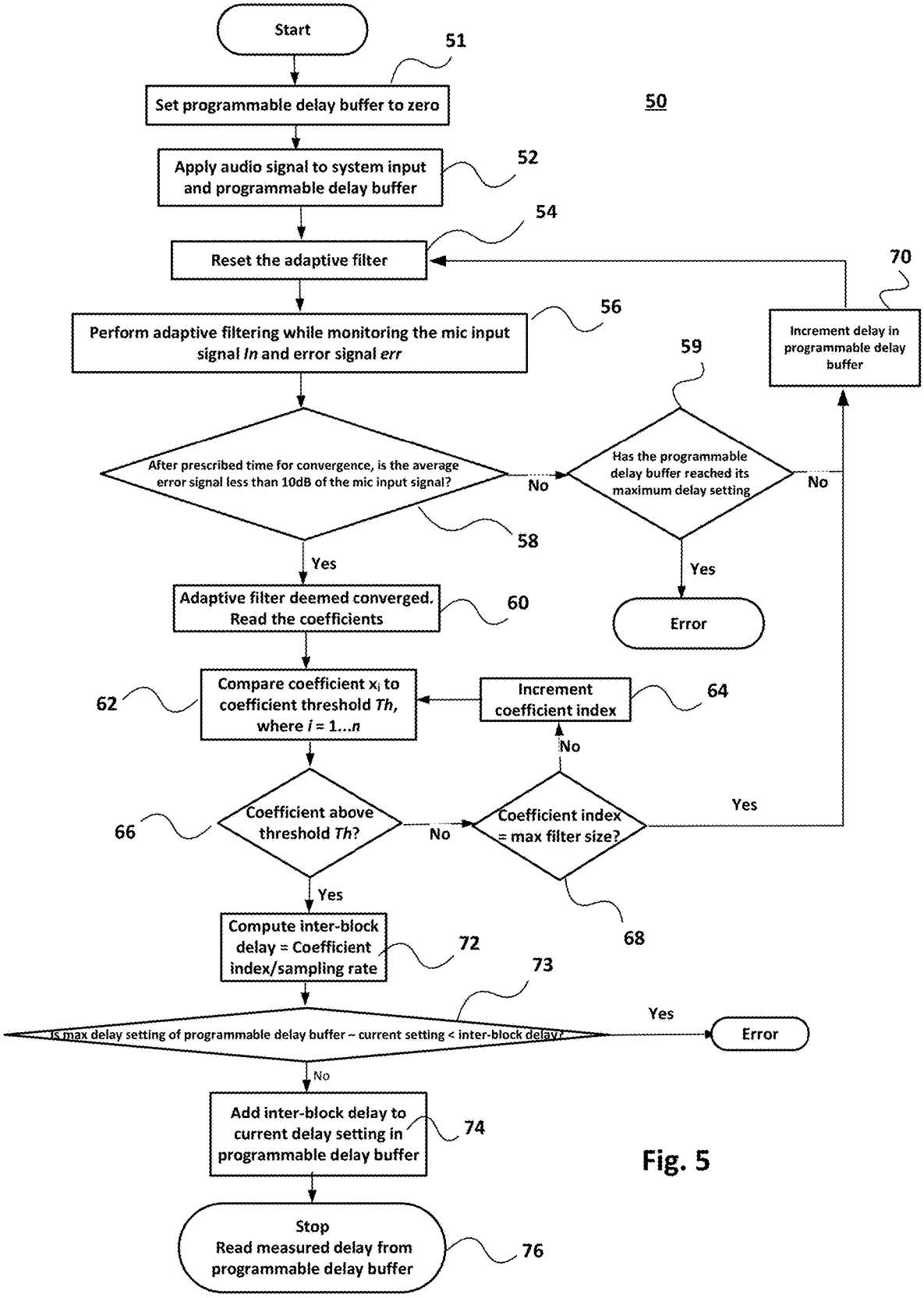
FIG. 5 is a flowchart showing the process of determining audio latency in an audio system according to an embodiment of the present invention.

FIG. 5 is a flowchart of the process 50 run in processor 15 for determining audio latency in the audio system 14.

Initially at step 51, the delay in the delay buffer 20 is set to zero.

At step 52, the audio stream 12 is input to the audio system 14, which could, for example, be a TV sound bar or speaker, and the programmable delay buffer 20 of the measurement apparatus 10. As noted, the audio system 14 generates the inherent delay, which is to be measured and which is included in the audio stream that is output from speaker 18. The programmable delay buffer 20 is normally set initially to zero delay, or as noted above, it could be set to a known finite value.

At step 54, the coefficients of the adaptive filter are reset to zero. The signal In, representing the inherent delay of the audio system 14, is input to the signal input of the adaptive filter 24.

Adaptive filtering is performed at step 56. The adaptive filter 24 is allowed to converge on a solution. At step 58, after a prescribed convergence time, typically 1 to 2 seconds, a determination is made as to whether the average error signal err is less than a threshold amount of the microphone input signal In, in this non-limiting example, less than 10 dB of the microphone input signal In; if yes, the adaptive filter 24 is deemed converged and the coefficients are read by the coefficient analysis block 30 at step 60.

If not, a determination is made at step 59 whether the delay in the programmable delay buffer 20 has reached its maximum delay setting. If the answer is negative, control passes to step 70, where delay in the programmable delay buffer 24 is incremented, for example, by 75% of the maximum delay available in the adaptive filter 24.

Control then passes back to step 54, and the adaptive filtering process is restarted. Adaptive filtering is then recommenced with some of the delay between signal In and the audio stream already accounted for by the programmable delay buffer 24. For example, if the total delay in the audio system is $T_d$, and the delay in the delay buffer is D, the new reference delay $ref_{new}$ presented to the adaptive filter 24 will be $ref_{new}=T_d, -D$. If not the adaptive filter 24 still does not converge, the sub-routine is repeated iteratively with a further delay added to the programmable delay buffer 24 until a programmable delay is found where the adaptive filter 24 will converge.

At step 62, the first coefficient xi is selected and a compared with a predetermined threshold value Th. A determination 66 is made as to whether the selected coefficient lies above the threshold value Th. As the initial coefficients will be at a value close to zero, the initial coefficients will have a value less than the coefficient threshold Th. If the coefficient value of the coefficient at index i is less than the coefficient threshold Th, the process moves to step 64, where the index i is incremented and the sub-routine repeated for the next selected coefficient until the first coefficient is found that is above the predetermined threshold, whereupon at step 72 the inter-block delay is computed as equal to the coefficient index/the sampling rate. The inter-block delay is the delay between the input signal In and the current reference signal ref which if the programmable delay buffer 20 has been incremented will include the delay introduced by the programmable delay buffer 20. The total delay will therefore be the inter-block delay plus the delay in the programmable delay buffer 20.

If at step 68 it is determined that the coefficient index is equal to the maximum filter size, meaning that the filter has no more capacity to increase the delay, control is passed to step 70, where the programmable delay buffer 20 is set to a percentage, in this non-limiting example, 75% of the maximum delay of the adaptive filter 24, and the sub-routine repeated to find a convergence value coefficient having a value that will likely be less than the maximum filter size because the delay between the input signal In and the reference signal ref will be less by an amount equal to 75% of the maximum delay of the adaptive filter.

At step 73 a determination is made as to whether there is room in the programmable delay buffer 20 to add inter-block delay; if not, an error is generated. If, yes control is passed to step 74.

At step 74, the inter-block delay is added to the current delay setting in the delay buffer and at step 76 the process is terminated. The measured delay, which is the total delay introduced by the audio system 14, can then be read out of the programmable delay buffer 20.

The measured delay can be used to align audio coming from a single source but being played out different systems. For example, a home audio system may use both Bluetooth and WiFi to send audio to different speakers. The inherent delay introduced by these devices is different and would be played out at slightly different times. With Amazon AVS being use to link multiple endpoints and designed by different end customers this becoming an important issue that needs to be solved.

Another example of where delay measurement is important in addressing the inherent delay in set top boxes. A tapped off version of the audio is passed to the TV or sound bar for further processing. This adds a significant amount of delay and pushes the echo portion of the return signal outside the filter. It seems like a common issue that needs to be solved for this application.

In this case a programmed delay buffer can be used to extend the effective size of the adaptive filter so that the adaptive filter can filter out echoes with a delay greater than its actual size.

Figure 6:
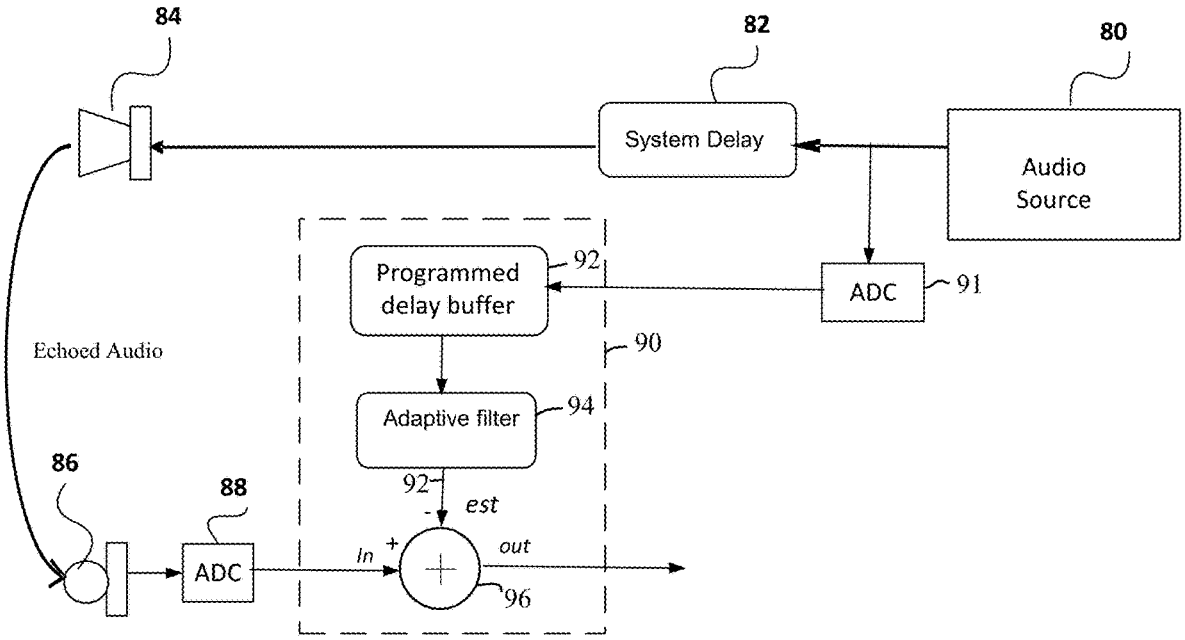
FIG. 6 shows an echo cancellation circuit incorporating a pre-measured delay in accordance with an embodiment of the invention.

FIG. 6 is an example of an echo cancellation circuit for removing an echo from an input signal. In this embodiment, an audio source 80, for example, from a TV set top box, incurs a system delay 82 that has previously been measured by the apparatus shown in FIG. 1. In this case, the delay has been previously measured by the apparatus shown in FIG. 1. The delay is taken from the programmable delay buffer 20 after the process has stopped at step 76 in FIG. 5. The output of speaker 84 is picked up as an echo by microphone 86, which produces signal In after passing through ADC 88. The objective is to remove the echo from the input signal In, so that far-end recipients do not hear the echo produced by the speaker 84. This is achieved by echo cancellation circuit 90, which includes the programmed delay buffer 92 that receives audio from the audio source 80 via ADC 91. The delayed audio is then fed into adaptive filter 94, which produces an estimated signal, which is subtracted from the input signal In to generate an output signal (out) in which the echo signal is at least partially attenuated; thereby effectively removing the echo.

This embodiment will cope with a delay greater than that which could be removed by the adaptive filter alone. As noted above there is a practical limit to the size of the adaptive filter 94. By pre-measuring and introducing part of the delay, which has been pre-measured by the circuit shown in FIG. 1, into the programmed delay buffer 92, the residual delay seen by the adaptive filter is considerably less and therefore brought within its capability to deal with.

It should be appreciated by those skilled in the art that any block diagrams herein represent conceptual views of illustrative circuitry embodying the principles of the invention. For example, a processor may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included. The functional blocks or modules illustrated herein may in practice be implemented in hardware or software running on a suitable processor. The term circuit includes an assembly of coupled functional components.

What is claimed is:

1. An acoustic delay measurement apparatus for measuring an audio delay introduced by an audio system, comprising:

a programmable delay buffer operative to receive an audio stream from an audio source and to output a reference signal representing the audio stream, said programmable delay buffer being operative to introduce a programmable delay into the audio stream, wherein said programmable delay is based upon a maximum delay available in an adaptive filter;

said adaptive filter responsive to said reference signal to generate an estimate signal to match, on convergence of the adaptive filter, a delayed audio stream output by the audio system, said delayed audio stream comprising said audio stream from said audio source delayed by an amount representative of an audio delay introduced by the audio system;

a processor including a coefficient analysis block, said coefficient analysis block operative to;

determine, after a prescribed convergence time, if the adaptive filter has converged, wherein convergence is deemed to occur when a magnitude of an error signal output by the adaptive filter is less than a predetermined amount of said delayed audio stream;

if it is determined that the adaptive filter has converged, read coefficients in the adaptive filter, compute a delay introduced by the adaptive filter into said estimate signal, and add the computed delay to the programmable delay introduced into the audio stream by the programmable delay buffer to provide a measurement of said audio delay;

if it is determined that the adaptive filter has not converged, set the programmable delay introduced by said programmable delay buffer into the received audio stream to a predetermined fraction of the maximum delay available in said adaptive filter to generate a new reference signal, restart said adaptive filter responsive to said new reference signal to generate a new estimate signal to match, on convergence of the adaptive filter, the delayed audio stream output by the audio system, output a new error signal, and if a magnitude of the new error signal is less than the predetermined amount of the delayed audio stream, read coefficients in the adaptive filter to re-compute the delay introduced by the adaptive filter into said estimate signal, and add the re-computed delay to the programmable delay introduced by the programmable delay buffer to provide the measurement of said audio delay; and continue to iteratively increase the programmable delay introduced by the programmable delay buffer and restart the adaptive filter until the adaptive filter is deemed to have converged.

2. The acoustic delay measurement apparatus of claim 1, wherein said coefficient analysis block computes the delay introduced by the adaptive filter on convergence by incrementally examining the coefficients read from said adaptive filter, and determining the first coefficient that exceeds a predetermined threshold value.

3. The acoustic delay measurement apparatus of claim 1, wherein the adaptive filter is a least mean squares (LMS) adaptive filter.

4. The acoustic delay measurement apparatus of claim 1, wherein the audio stream is a wideband audio signal.

5. The acoustic delay measurement apparatus of claim 1, wherein the adaptive filter is coupled to a microphone to pick up said audio signal after passing through said audio system.

6. The acoustic delay measurement apparatus of claim 1, wherein said programmable delay buffer comprises a buffer memory with read and write pointers separated by a programmable number of memory locations to determine the delay introduced by said programmable delay buffer.

7. An acoustic delay measurement apparatus for measuring an audio delay introduced by an audio system, comprising:

a programmable delay buffer operative to receive an audio stream from an audio source and output a reference signal representing the audio stream, said programmable delay buffer being operative to introduce a programmable delay into the audio stream, wherein said programmable delay is based upon a maximum delay available in an adaptive filter;

said adaptive filter responsive to said reference signal to generate an estimate signal to match, on convergence of the adaptive filter, a delayed audio stream output by the audio system, said delayed audio stream comprising said audio stream from said audio source delayed by an amount representative of an audio delay introduced by the audio system; and a processor including a coefficient analysis block, said coefficient analysis block operative to read coefficients in the adaptive filter after convergence, compute a delay introduced by the adaptive filter into said estimate signal by incrementally examining the coefficients read from said adaptive filter and determine the first coefficient that exceeds a predetermined threshold value, wherein said adaptive filter has a particular size, and if said coefficient analysis block determines that said first coefficient corresponds to the particular size of said adaptive filter, said processor sets the programmable delay introduced by said programmable delay buffer into the received audio stream to a predetermined fraction of the maximum delay available in said adaptive filter to output a new reference signal, directs the adaptive filter to converge on the new reference signal, re-computes the delay introduced by the adaptive filter for the new reference signal, and adds the re-computed delay to the programmable delay introduced by the programmable delay buffer to provide a measurement of said audio delay, and wherein if said first coefficient does not correspond to the particular size of said adaptive filter, the processor is operative to add the computed delay to the programmable delay introduced by the programmable delay buffer to provide the measurement of said audio delay.

8. A computer-implemented method of determining audio latency in an audio system, comprising:

applying an audio stream obtained from an audio source to the audio system possessing latency;

applying a delayed audio stream obtained from the audio system to a first input of an adaptive filter;

applying a reference signal to a second input of said adaptive filter to permit the adaptive filter to generate an estimate signal of the delayed audio stream upon convergence, the reference signal being obtained from the audio stream after passing through a programmable delay buffer to introduce a programmable delay into the audio stream, wherein the programmable delay is based upon a maximum delay available in said adaptive filter, and wherein convergence is deemed to have occurred when a magnitude of an error signal output by the adaptive filter is less than a predetermined fraction of said delayed audio stream;

if the adaptive filter fails to converge, incrementing the programmable delay buffer by a predetermined amount of the maximum delay available in said adaptive filter to introduce a programmable delay into the received audio stream and to generate a new reference signal for the adaptive filter and restarting the adaptive filter; and upon convergence of the adaptive filter, computing a delay introduced by the adaptive filter into the estimate signal and adding the computed delay to the programmable delay introduced by the programmable delay buffer to provide a measurement of the audio delay.

9. The computer-implemented method of claim 8, wherein the adaptive filter is a least mean squares (LMS) adaptive filter.

10. The computer-implemented method of claim 8, wherein the audio stream is a wideband audio signal.

11. The computer-implemented method of claim 8, wherein the adaptive filter is coupled to a microphone to pick up said audio signal after passing through said audio system.

12. The computer-implemented method of claim 8, wherein samples from the audio stream are sequentially written into the programmable delay buffer at locations determined by a write pointer and read out at locations determined by a read pointer, said read pointer being a certain number of memory locations behind the write pointed, said certain number determining the delay introduced by the programmable delay buffer.

13. The computer-implemented method of claim 8, further comprising the step of aligning speakers outputting sound from a common or different source using the measurement of the audio delay.

14. The computer-implemented method of claim 8, wherein the delay introduced by the adaptive filter is computed by incrementally examining coefficients read from the adaptive filter and determining the first coefficient that exceeds a predetermined threshold value.

15. The computer-implemented method of claim 14, wherein the adaptive filter has a particular size, and if the first coefficient corresponds to the particular size of said adaptive filter, a predetermined fraction of the maximum delay available in said adaptive filter is introduced in said audio stream to output a new reference signal, the adaptive filter is allowed to converge on the new reference signal, and the delay introduced by the adaptive filter into the estimate signal is re-computed for the new reference signal.

* * * * *